US005365959A

United States Patent [19]

Favaro

[11] Patent Number: 5,365,959

[45] Date of Patent: Nov. 22, 1994

[54] BUILT-IN DISHWASHER WITH HIDDEN CONTROL PANEL

[75] Inventor: Daniele Favaro, Venice, Italy

[73] Assignee: Zanussi Elettrodomestici S.P.A., Italy

[21] Appl. No.: 94,557

[22] Filed: Jul. 20, 1993

[30] Foreign Application Priority Data

Jul. 23, 1992 [IT] Italy ..... PN92U000027

[51] Int. Cl.[5] ..... A47L 15/42

[52] U.S. Cl. ..... 134/113; 134/201; 312/228

[58] Field of Search ..... 134/201, 56 D, 57 D, 134/58 D, 57 DL, 58 DL, 113; 68/12.27; 312/228, 327, 328

[56] References Cited

U.S. PATENT DOCUMENTS 3,028,870 4/1962 Fay ..... 134/58 DL
3,064,662 11/1962 Given et al. ..... 134/113 X
3,853,366 12/1974 Kesling et al. ..... 312/228
5,151,884 9/1992 Griffith et al. ..... 134/57 D X

FOREIGN PATENT DOCUMENTS 0343153 11/1989 European Pat. Off. ..... 68/12.27
158995 6/1989 Japan ..... 68/12.27
2238576 11/1990 United Kingdom ..... 134/201

*Primary Examiner*—Philip R. Coe
*Attorney, Agent, or Firm*—Pearne, Gordon, McCoy & Granger

[57] ABSTRACT

Built-in dishwasher with a front-opening door (1) furnished with an exterior panel (2) and having a control panel on the top part. The control panel has a timer (5) which can be adjusted by a front knob (6). The knob (6) is built into a niche (7) of the control panel (3) and its side is accessible from the top by an opening (8) along the top edge of the control panel (3). The side of the knob (6) has graphics indicating the machine's operating programs.

8 Claims, 3 Drawing Sheets

BUILT-IN DISHWASHER WITH HIDDEN CONTROL PANEL

BACKGROUND OF THE INVENTION

The present document refers to a built-in dishwasher of the kind in which the control panel is "hidden" when the door of the machine is closed.

In a dishwasher of this type, described in GB-A-2 238 576, the loading door is covered by a decorative panel and has the main controls of the machine on the top edge, joined with the control panel and accessible only when the door of the machine is open. When the door is closed, the controls are hidden and protected by a front protrusion of the counter-top into which the machine is built.

Owing to space considerations, until now it has not been possible to mount a traditional electro-mechanical timer with a front knob onto the control panel in the dishwasher of this kind. For this reason, the control panel must include additional keys to select the various programs. In addition, the additional keys must be linked to a timer having quick-moving cams and which in turn is linked to special electronic control devices. The entire control panel becomes undesirably complex, expensive and not very reliable.

The objective of the present invention is to supply a built-in dishwasher furnished with a hidden control panel which is particularly simple, reliable and easy to use.

According to the invention, such an objective is obtained in a built-in dishwasher with a hidden control panel which incorporates the characteristics of the attached claims.

BRIEF DESCRIPTION OF THE DRAWINGS

The characteristics and the advantages of the invention will be made clear by the following description, which is given only as a non-limiting example, with reference to the attached drawings in which.

DETAILED DESCRIPTION OF THE PREFERRED EMBODIMENT

Figure 1:
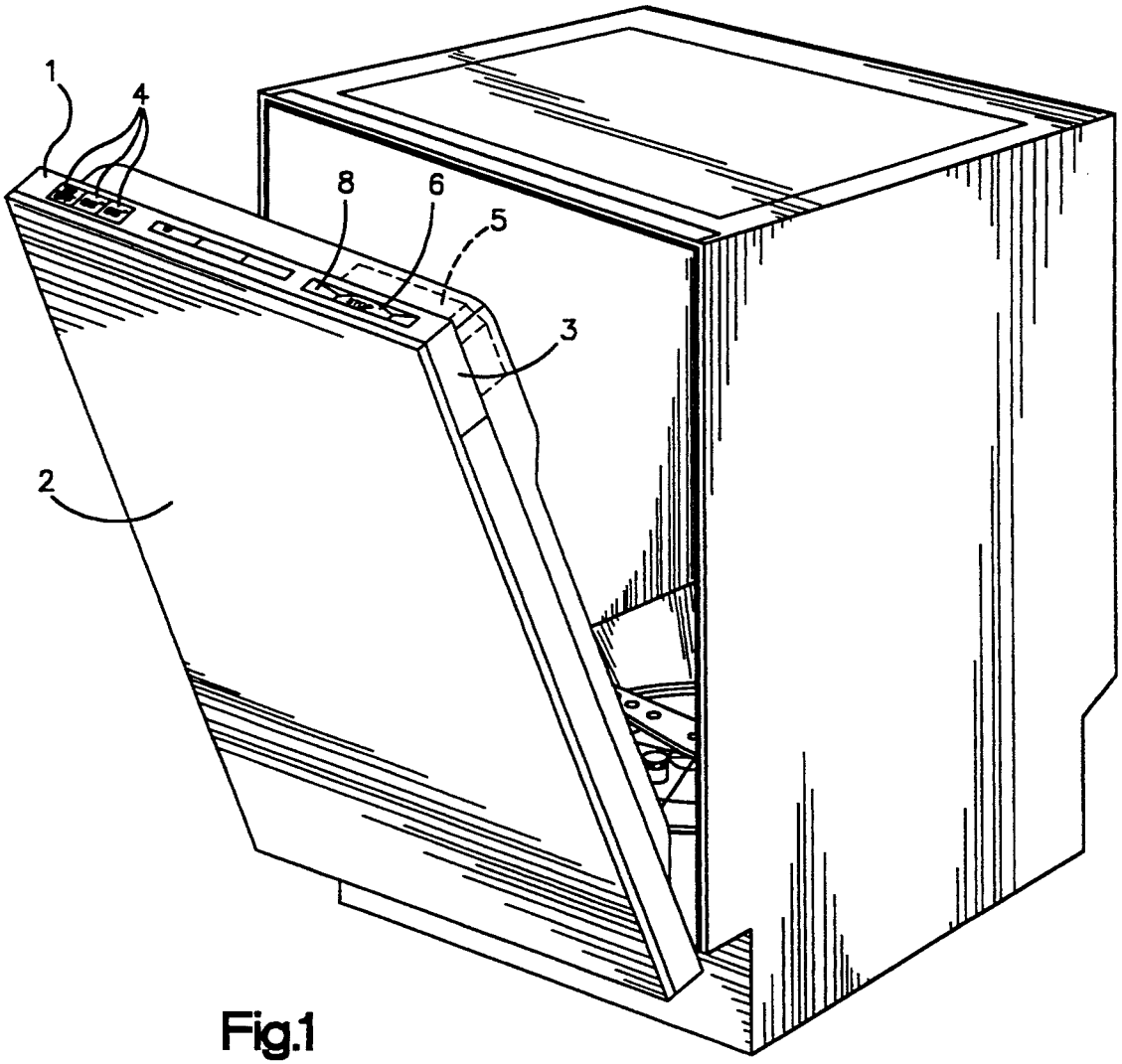
FIG. 1 schematically shows a dishwasher, according to the invention, with the loading door partially open.
Figure 2:
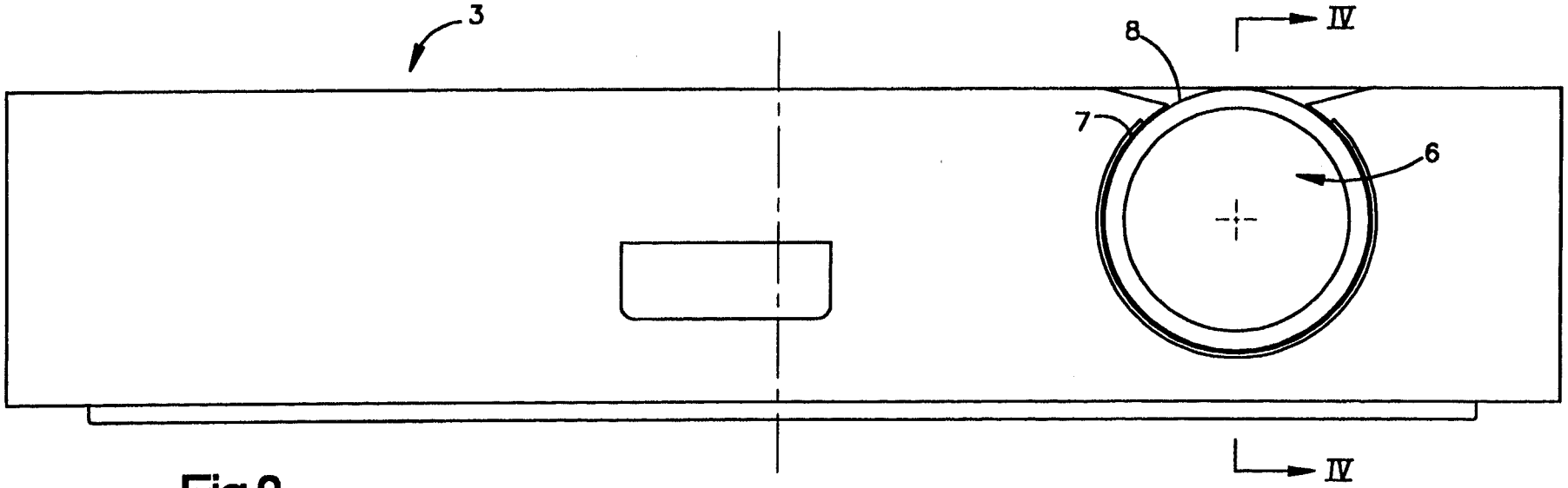
FIG. 2 schematically shows a front view of the control panel for the dishwasher in FIG. 1 constructed in the preferred manner.
Figure 3:
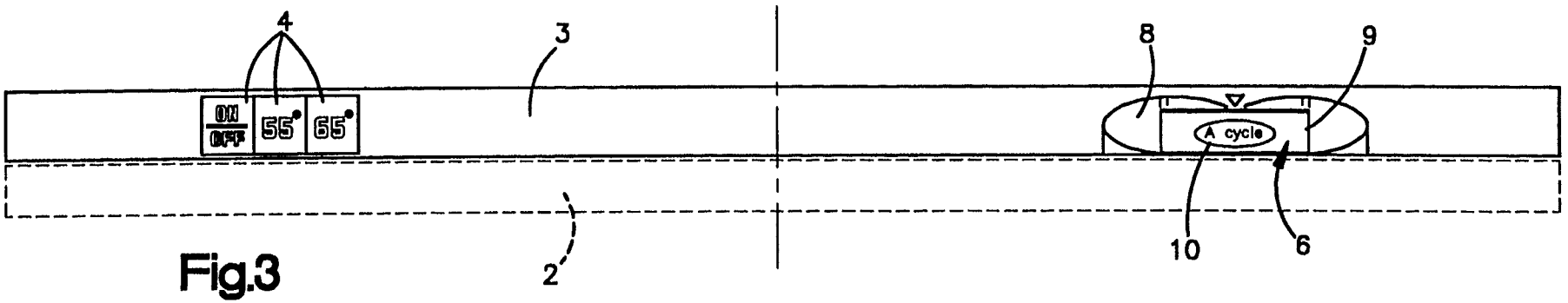
FIG. 3 schematically shows a top view of the control panel from FIG. 2.
Figure 4:
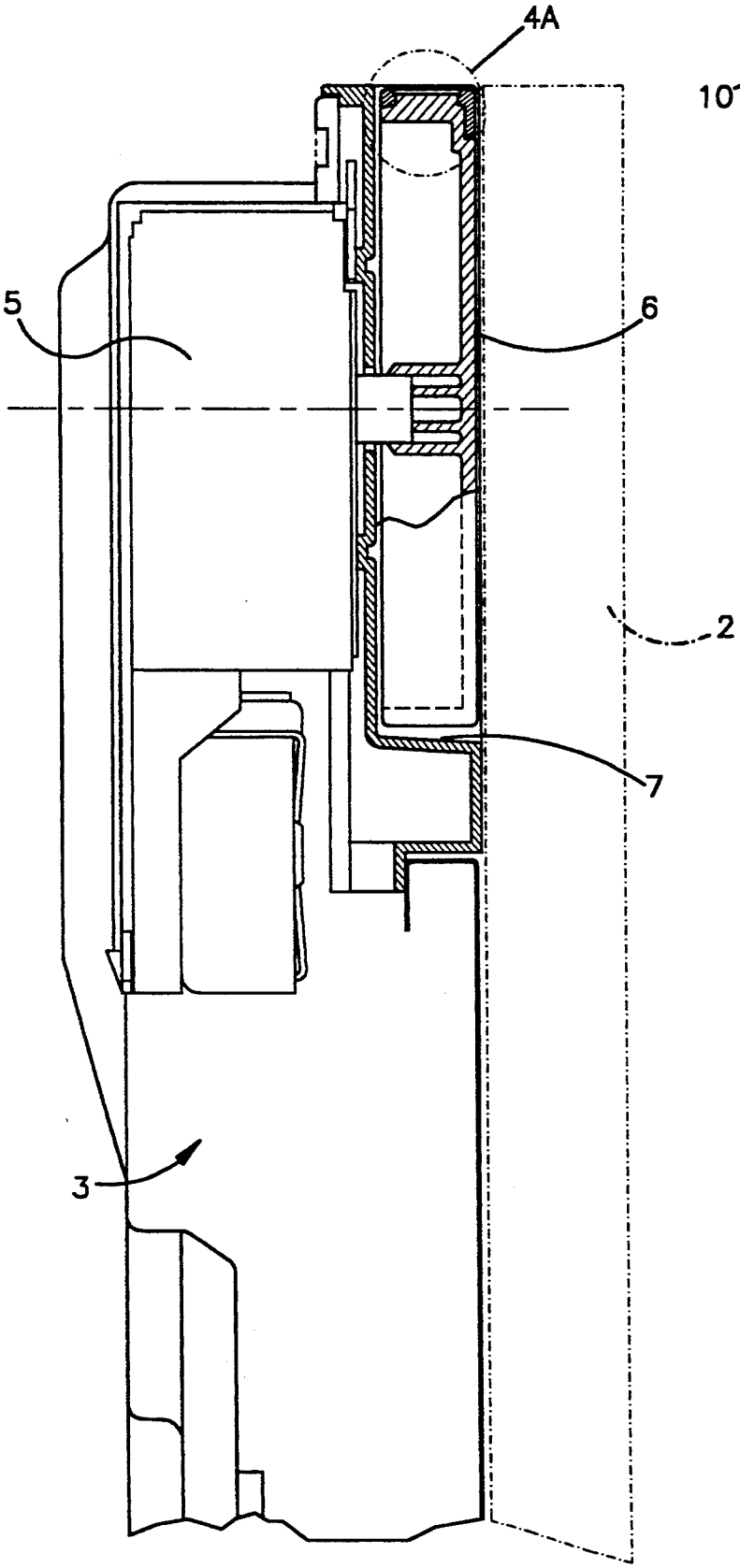
FIG. 4 schematically shows a section view taken along line IV—IV of FIG. 2.
Figure 4A:
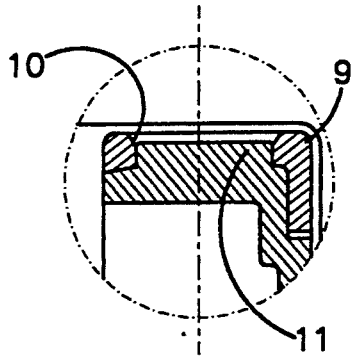
FIG. 4A shows a detailed view of a section of a knob shown in FIG. 4.

With reference to the figures, the dishwasher is the built-in type and includes a front loading door (1) substantially covered by a decorative external panel (2). The panel (2) can be placed onto the door (1) as described for example in the aforementioned GB-A-2 238 576, or can be rigidly affixed to it. The top part of the door (1) includes a control panel (3) which houses the main controls for the machine. The control panel is hidden behind the decorative panel (2) and, when the door (1) is closed, by a front protrusion of the counter-top into which the machine is built. On the top edge of the control panel (3), accessible when the door (1) is open, buttons (4) are placed to control some functions of the machine. Some of those functions include power, temperature setting, an "energy-saving" function, etc. In addition, the control panel (3) includes a traditional electro-mechanical timer (5) with simple cams mounted on a small rotating drag roller which is substantially horizontal. It is well-known that a timer of this kind is advantageous, simple, reliable and economical and can be run by means of a front control knob (6), which is coaxial to the timer's small roller, to select various operating programs of the machine.

According to one aspect of the document, the timer knob (6) is built into a corresponding niche (7) in the control panel (3) in such a way as not to impede the mounting of the decorative panel (2) along the front surface of the door (1). The side (perimeter) of the knob (6) is accessible from the top, when the door (1) is open, through an opening (8) in the top edge of the control panel (3) which leads to the niche (7). Traditional graphics or characters indicating the running of the machine's various operating programs should preferably be placed on the side of the knob (6) in order to be legible through the opening (8), thereby allowing the user to run the timer (5) in a precise manner.

In order to facilitate the use of the knob (6), at least its side panel should be constructed of a material with a high friction coefficient. Preferably, the surface should include a flexible rubber ring (9) or similar device, mounted around the knob (6) and rotating in conjunction with it. In order to ensure that the graphics on the side of knob (6) can be seen, the ring (9) should have perforations (10) corresponding to the respective graphic. Preferably, said graphics should be placed in correspondence with respective radial protrusions (11) of the knob's (6) side panel; said protrusions latch into respective perforations (10) of the ring (9), which in this way results in efficient rotation in conjunction with the knob (6).

Obviously, the dishwasher described is only an example and can undergo any number of modifications in line with the plans and the description, as long as the characteristics described in the attached claims remain.

Although the preferred embodiments of this invention have been shown and described, it should be understood that various modifications and rearrangements of the parts may be resorted to without departing from the scope of the invention as disclosed and claimed herein.

What is claimed is:

1. A built-in dishwasher having a front-loading door covered with an external decorative panel and a control panel having an electro-mechanical timer with cams mounted on a substantially horizontal rotating shaft, the timer being adjustable by means of a front knob (6) having a side, characterized by a niche (7) in the control panel (3), said knob (6) being built into said niche (7), and an opening (8) on a top edge of the control panel (3) providing access to the side of the knob (6) from above.

2. A dishwasher as described in claim 1, in which said knob (6) includes graphics indicating operating programs which can be selected, characterized by the fact that these graphics are placed on a side surface of the knob (6) in such a way as to be visible through the opening (8).

3. A dishwasher as described in claim 1, characterized by a fact that at least the side surface of the knob (6) is constructed of a material with a high friction coefficient.

4. A dishwasher as described in claim 1, further comprising a ring (9) with a high friction coefficient mounted around a side surface of the knob (6), this ring rotating in conjunction with the knob.

5. A dishwasher as described in claim 4, characterized by the fact that said ring (9) includes perforations (10) which correspond to respective graphics on the side surface on the knob (6) .

6. A dishwasher as described in claim 5, further comprising radial protrusions (11) on the side surface of the knob (6) and characterized by the fact that said graphics correspond to respective radial protrusions (11), said protrusions fitting into the respective perforations (10) of the ring (9) in such a way as to make it rotate in conjunction with the knob (6).

7. A dishwasher as described in claim 4, characterized by the fact that said ring (9) includes perforations (10) which correspond to respective graphics on the side surface on the knob (6).

8. A dishwasher as described in claim 7, further comprising radial protrusions (11) on the side surface of the knob (6) and characterized by the fact that said graphics correspond to respective radial protrusions (11), said protrusions fitting into the respective perforations (10) of the ring (9) in such a way as to make it rotate in conjunction with the knob (6).

* * * * *